US007560872B2

(12) United States Patent
Lyle, Jr. et al.

(10) Patent No.: US 7,560,872 B2
(45) **Date of Patent: *Jul. 14, 2009**

(54) DC-AC CONVERTER HAVING PHASE-MODULATED, DOUBLE-ENDED, HALF-BRIDGE TOPOLOGY FOR POWERING HIGH VOLTAGE LOAD SUCH AS COLD CATHODE FLUORESCENT LAMP

(75) Inventors: Robert L. Lyle, Jr., Raleigh, NC (US); Steven P. Laur, Raleigh, NC (US); Zaki Moussaoui, Palm Bay, FL (US)

(73) Assignee: Intersil Americas Inc., Milpitas, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/175,486

(22) Filed: Jul. 6, 2005

(65) Prior Publication Data

US 2006/0170371 A1 Aug. 3, 2006

Related U.S. Application Data

(63) Continuation-in-part of application No. 11/046,976, filed on Jan. 31, 2005, now Pat. No. 7,368,880.

(60) Provisional application No. 60/673,123, filed on Apr. 20, 2005.

(51) Int. Cl.
*H05B 37/02* (2006.01)
*H05B 37/00* (2006.01)
*H05B 41/16* (2006.01)

(52) U.S. Cl. ..... 315/220; 315/224; 315/226; 315/244; 315/277; 315/291

(58) Field of Classification Search ..... 315/209 R, 315/219, 220, 223, 224–226, 227 R, 239, 315/241 R, 242, 243, 244, 246, 276, 277, 315/283, 291, 307
See application file for complete search history.

(56) References Cited

U.S. PATENT DOCUMENTS

| | | | | |
|---|---|---|---|---|
| 2,786,967 | A | 3/1957 | Kuenning | 315/163 |
| 5,187,411 | A | 2/1993 | Boyd et al. | |
| 5,559,395 | A | 9/1996 | Venkitasubrahmanian et al. | |
| 5,604,409 | A | 2/1997 | Fisher | |
| 5,615,093 | A | 3/1997 | Nalbant | |
| 5,859,505 | A | 1/1999 | Bergman et al. | |

(Continued)

FOREIGN PATENT DOCUMENTS

| | | |
|---|---|---|
| JP | 2004241136 | 8/2004 |

(Continued)

*Primary Examiner*—Douglas W Owens
*Assistant Examiner*—Minh Dieu A
(74) *Attorney, Agent, or Firm*—Fogg & Powers LLC

(57) ABSTRACT

A phase-modulated, double-ended, half-bridge topology-based DC-AC converter supplies AC power to a load, such as a cold cathode fluorescent lamp used to back-light a liquid crystal display. First and second converter stages generate respective first and second sinusoidal voltages having the same frequency and amplitude, but having a controlled phase difference therebetween. By employing a voltage controlled delay circuit to control the phase difference between the first and second sinusoidal voltages, the converter is able to vary the amplitude of the composite voltage differential produced across the opposite ends of the load.

21 Claims, 5 Drawing Sheets

U.S. PATENT DOCUMENTS

| | | | | |
|---|---|---|---|---|
| 5,923,129 | A | 7/1999 | Henry | |
| 5,930,121 | A | 7/1999 | Henry | |
| 5,932,976 | A | 8/1999 | Maheshwari et al. | |
| 5,945,785 | A | 8/1999 | Kido et al. | |
| 5,963,443 | A | 10/1999 | Mihara | 363/134 |
| 6,057,652 | A | 5/2000 | Chen et al. | |
| 6,114,814 | A | 9/2000 | Shannon et al. | |
| 6,194,840 | B1 | 2/2001 | Chang | |
| 6,198,234 | B1 | 3/2001 | Henry | |
| 6,225,751 | B1 | 5/2001 | Komatsu | 315/209 R |
| 6,326,740 | B1 | 12/2001 | Chang et al. | |
| 6,396,722 | B2 | 5/2002 | Lin | |
| 6,429,604 | B1 | 8/2002 | Chang | |
| 6,570,344 | B2 | 5/2003 | Lin | |
| 6,815,906 | B1 | 11/2004 | Aarons et al. | 315/209 R |
| 6,936,975 | B2 * | 8/2005 | Lin et al. | 315/224 |
| 7,030,568 | B2 * | 4/2006 | Boke et al. | 315/224 |
| 7,075,245 | B2 | 7/2006 | Liu | |
| 7,119,495 | B2 | 10/2006 | Jang | |
| 7,126,289 | B2 * | 10/2006 | Lin et al. | 315/308 |
| 7,187,139 | B2 | 3/2007 | Jin | |
| 2003/0085669 | A1 | 5/2003 | Pak | |
| 2004/0263092 | A1 | 12/2004 | Liu | |
| 2005/0017803 | A1 | 1/2005 | Jonkman | |
| 2005/0062436 | A1 * | 3/2005 | Jin | 315/244 |
| 2005/0093471 | A1 | 5/2005 | Jin | 315/177 |
| 2005/0093472 | A1 | 5/2005 | Jin | 314/177 |
| 2005/0219863 | A1 | 10/2005 | Fukumoto et al. | |
| 2005/0225261 | A1 | 10/2005 | Jin | 315/255 |
| 2005/0225514 | A1 | 10/2005 | Ahn et al. | |
| 2006/0012312 | A1 | 1/2006 | Lyle, Jr. et al. | |
| 2006/0170378 | A1 | 8/2006 | Lyle, Jr. et al. | |

FOREIGN PATENT DOCUMENTS

| | | | |
|---|---|---|---|
| WO | WO2005038828 | 4/2005 | 41/16 |
| WO | WO2005101928 | 4/2005 | 37/2 |

* cited by examiner

OUT OF PHASE
2.0KV
0V
-2.0KV
30V
20V
10V
-5V
40V
-20V
-40V
SEL>>
2.30ms
2.31ms
2.32ms
2.33ms
2.34ms
2.35ms
201
202
301
302
401
402
1 V(C_LPF_1:1) 2 V(U_Q1:3)
1 V(C_LPF_2:1) 2 V(U_Q3:3)
1 V(R_LAMP:2,R_LAMP:1) 2 V(U_Q1:3,U_Q3:3)

IN PHASE
2.0KV
0V
-2.0KV
30V
20V
10V
-5V
40V
-20V
-40V
SEL>>
1.90 ms
1.91 ms
1.92 ms
1.93 ms
1.94 ms
1.95 ms
501
502
601
602
701
702
1 V(C_LPF_1:1) 2 V(U_Q1:3)
1 V(C_LPF_2:1) 2 V(U_Q3:3)
1 V(R_LAMP:2,R_LAMP:1) 2 V(U_Q1:3,U_Q3:3)

TRANSITION FROM IN PHASE TO OUT OF PHASE DUE TO V BRT CHANGE FROM 0V TO 1.5V
902
901
2.0V
1.0V
0V
V(V_LPF_1:1)
V(Vbrt)
V(C_LPF_1:1)
V(U_Q1:3)
V(C_LPF_2:1)
V(U_Q2:3)
V(R_LAMP_1:2R_LAMP1:1)
V(U_Q1:3,_Q3:3)
30V
20V
10V
>>
.5V
2.0KV
0V
-2.0KV
-30V
SEL>>
0.96ms
1.00ms
1.04ms
1.08ms
1.12ms
1.16ms
1.20ms
TIME
1201
1202

DC-AC CONVERTER HAVING PHASE-MODULATED, DOUBLE-ENDED, HALF-BRIDGE TOPOLOGY FOR POWERING HIGH VOLTAGE LOAD SUCH AS COLD CATHODE FLUORESCENT LAMP

CROSS-REFERENCE TO RELATED APPLICATIONS

The present application is a continuation-in-part of co-pending U.S. patent application, Ser. No. 11/046,976, filed Jan. 31, 2005 (hereinafter referred to as the '976 application), entitled: "Phase Shift Modulation-Based Control of Amplitude of AC Voltage Output Produced by Double-Ended DC-AC Converter Circuitry for Powering High Voltage Load Such as Cold Cathode Fluorescent Lamp," by R. Lyle, Jr. et al, assigned to the assignee of the present application and the disclosure of which is incorporated herein. In addition, the present application claims the benefit of co-pending U.S. Patent Application, Ser. No. 60/673,123, filed Apr. 20, 2005, by Robert L. Lyle, Jr. et al, entitled: "DC-AC Converter Having Phase-Modulated, Double-Ended, Half-Bridge Topology For Powering High Voltage Load Such As Cold Cathode Fluorescent Lamp," assigned to the assignee of the present application and the disclosure of which is incorporated herein.

FIELD OF THE INVENTION

The present invention relates in general to power supply systems and subsystems thereof, and is particularly directed to a phase-modulated, double-ended, half-bridge topology-based method and apparatus for controlling the resultant amplitude of an AC voltage applied across opposite ends of a high voltage device, such as a cold cathode fluorescent lamp (CCFL) of the type employed for back-lighting a liquid crystal display.

BACKGROUND OF THE INVENTION

There are a variety of electrical system applications which require one or more sources of high voltage AC power. As a non-limiting example, a liquid crystal display (LCD), such as that employed in desktop and laptop computers, or in larger display applications such as large scale television screens, requires an associated set of cold cathode fluorescent lamps (CCFLs) mounted directly behind it for back-lighting purposes. In these and other applications, ignition and continuous operation of the CCFLs require the application of a high AC voltage that can range on the order of several hundred to several thousand volts. Supplying such high voltages to these devices has been customarily accomplished using one of several methodologies.

A first technique involves the use a single-ended drive system, wherein a - high voltage AC voltage generation and control system is transformer-coupled to one/near end of the lamp, while the other/far end of the lamp is connected to ground. This method is undesirable, as it involves the generation of a very high peak AC voltage in the high voltage transformer circuitry feeding the driven end of the lamp.

A second technique involves the use a double-ended drive system, wherein a high voltage AC voltage generation and control system is transformer-coupled to one/near end of the lamp, while connection from the voltage generation and control system to the other/far end of the lamp is effected through high voltage wires. These wires can be relatively long (e.g., four feet or more), making them more expensive than low voltage wires; in addition, they lose substantial energy through capacitive coupling to ground. This method is also very undesirable, as it involves the generation of a very high peak AC voltage in the high voltage transformer circuitry feeding the driven end of the lamp.

Another approach is to place a high voltage transformer and associated voltage switching devices, such as MOSFETs or bipolar transistors, near the far end of the lamp; these devices are connected to and controlled by a local controller at the near end of the lamp. This method has disadvantages similar to the first, in that the gate (or base) drive wires are required to carry high peak currents and must change states at high switching speeds for efficient operation. The long wires required are not readily suited for these switching speeds, due their inherent inductance; in addition they lose energy because of their substantial resistance.

Pursuant to the invention disclosed in the above-referenced '976 application, these and other disadvantages of conventional high voltage AC power supply system architectures, including systems for supplying AC power to CCFLs used to back-light an LCD panel, are effectively obviated by means of a double-ended, DC-AC converter architecture, which is operative to drive opposite ends of a load, such as a CCFL, with a first and second sinusoidal voltages having the same frequency and amplitude, but having a controlled phase difference therebetween. By controlling the phase difference between the first and second sinusoidal voltages, it is possible to control the amplitude of the composite voltage differential produced across the opposite ends of the load.

In accordance with a first, voltage-driven, push-pull embodiment, the invention disclosed in the '976 application is implemented by means of first and second, voltage-fed, push-pull DC-AC converter stages having respective output ports coupled to opposite ends of the load (CCFL). Each push-pull converter stage contains a pair of pulse generators which produce phase-complementary rectangular wave pulse signals of the same amplitude and frequency having a 50% duty cycle. These phase-complementary pulse signals are used to control the ON/OFF conduction of a pair of controlled switching devices, such as respective MOSFETs, whose source-drain paths are coupled between a reference voltage terminal (e.g., ground) and opposite ends of a center-tapped primary coil of a step-up transformer. The center tap of the primary coil of the step-up transformer is coupled to a DC voltage source, which serves as the DC voltage feed for that DC-AC converter stage. The secondary coil of the step-up transformer has a first end coupled to a reference voltage (e.g., ground) and a second end coupled by way of an RLC output filter to one of the two output ports. The RLC circuit converts the generally rectangular wave output produced across the secondary winding of the step-up transformer into a generally sinusoidal waveform.

In operation, the complementary phase, rectangular waveform, 50% duty cycle output pulse trains produced by the two pulse generators alternately turn the two MOSFETs ON and OFF, in a mutually complementary manner. Whichever MOSFET is turned on will provide a current flow path to ground from the voltage source feed through half of the center tapped primary winding and the drain-source path of that MOSFET. The alternating of the conduction cycles of the two MOSFETs of a respective converter stage has the effect of producing a generally rectangular output pulse waveform having a 50% duty cycle across the secondary winding of the step-up transformer for that stage. The amplitude of this voltage waveform corresponds to the product of the secondary: primary turns ratio of the transformer and twice the value of the DC voltage of the voltage feed source. The shape of this generally rectangular waveform is converted by the RLC filter into a relatively well defined sinusoidal waveform, that is supplied to one of the two output ports and thereby to one end of the load (CCFL).

The controlled phase shift mechanism serves to controllably shift the phase of the sinusoidal waveform produced by the output RLC filter of one of the converter stages by a prescribed amount relative to the phase of the sinusoidal waveform produced by the output RLC filter of the other converter stage. This controlled imparting of a differential phase shift between the sinusoidal waveforms appearing at the two output ports has the effect of modifying the shape and thereby the amplitude of the composite AC signal produced between the two output ports.

Producing the incremental phase offsets between the two waveforms generated by the two converter stages may be readily accomplished by imparting a controlled amount of delay to the pulse trains produced by the pulse generators of one of the converter stages relative to the pulse trains produced by pulse generators of the other converter stage. The amount of delay between the two pulse trains will control the shape and thereby the amplitude of the composite AC waveform produced across the output ports.

A second, current-fed embodiment of the invention disclosed in the '976 application comprises first and second, current-fed, push-pull DC-AC converter stages respective output ports of which are coupled to opposite ends of a load such as a CCFL, as in the first embodiment. As in the first embodiment, the current-fed, double ended push-pull, DC-AC converter stages are operative to produce first and second sinusoidal voltages having the same frequency and amplitude, but having a controlled phase difference therebetween, which is effective to modulate the amplitude of the composite AC voltage produced across the opposite ends of the load.

As in the first embodiment, each current-fed, converter stage has a pair of complementary pulse generators, which produce phase-complementary rectangular output pulse signals having a 50% duty cycle. Each rectangular wave signal is applied to the control terminal of a controlled switching device, such a controlled relay, which is operative to controllably interrupt a current flow path therethrough coupled between a prescribed reference voltage (e.g., ground) and one end of a parallel connection of a capacitor and a center-fed primary winding of a step-up transformer, which form a resonant tank circuit, that serves to deliver a resonant sinusoidal waveform of a fixed frequency and amplitude to the secondary winding of the transformer. The primary winding of the step-up transformer has its center tap coupled through a resistor and an inductor to a DC voltage source, which serves as the current feed for that converter stage.

In operation, the complementary phase, rectangular waveform 50% duty cycle output pulse trains produced by the pair of pulse generators alternately close and open the controlled switches in a complementary manner. Whenever a switch is closed, a current flow path is established from the battery terminal though an inductor and resistor to the center tap of the transformer's primary winding, and therefrom through half of the primary winding, a resistor and the closed current flow path through the switch to ground. A prescribed time after the closure of one switch and the opening of the other switch, the states of the two pulse signal inputs to the control inputs of switches are reversed. Due to the inherent inertia property of the transformer's primary winding, current therethrough does not immediately cease flowing. Instead, current from the primary winding flows into one side of the capacitor connected in parallel with the primary winding.

The resonant circuit formed by the capacitor and the primary of the step-up transformer results in a ringing of the current between the capacitor and the primary winding of the transformer, which serves to induce a sinusoidal waveform across the secondary winding. The waveform on one side of the resonant tank capacitor is a one-half positive polarity sine wave, while the waveform on the other side of the capacitor is a one-half negative polarity sine-wave. The resultant of the two one-half sine waves, which is applied to one of the output ports, is a sine wave of fixed amplitude, frequency and phase.

In order to controllably shift the phase of the resultant sine wave supplied to the one output port relative to the other output port, transitions in the complementary 50% duty cycle pulse trains produced by the pulse generators of one converter stage are incrementally delayed with respect to the pulse trains produced by the pulse generators of the other stage, so as to controllably shift the phase of the sine wave supplied to the one output port relative to the other output port. As in the voltage-fed embodiment, incrementally offsetting in phase of the two sine waveforms produced by the push-pull DC-AC converter stages of the current-fed embodiment serves to vary or modulate the amplitude of the composite waveform produced across the two output terminals.

A voltage controlled delay circuit is used to define the relative delay between the complementary pulse trains that are applied to the pulse generators within the respective push-pull DC-AC converter stages of the embodiments of the invention, and thereby control the amplitude of the composite AC waveform produced across the driven load. Incrementally varying the magnitude of the DC voltage applied to the voltage control input serves to controllably adjust the delay between the transitions in the complementary 50% duty cycle pulse trains produced by one pair of pulse generators with respect to the pulse trains produced by the other pair of pulse generators, so as to controllably shift the phase of the resultant sine wave supplied to one output port relative to the sine wave applied to the other output port. This serves to modulate the amplitude of the composite AC voltage produced across the opposite ends of the load.

SUMMARY OF THE INVENTION

The present invention is directed to a different implementation for performing the functionality of the above-described phase-modulated, double-ended, method and apparatus for controlling the resultant amplitude of an AC voltage applied across opposite ends of a high voltage device. In particular, the present invention is directed to a half-bridge topology which, like the push-pull implementation described above, is operative to drive opposite ends of a load, such as a CCFL, with first and second sinusoidal voltages having the same frequency and amplitude, but having a controlled phase difference therebetween, so that it is able to vary the amplitude of the composite voltage differential produced across the opposite ends of the load.

For this purpose, the half-bridge topology includes a first half-bridge DC-AC converter stage containing a pulse generator, which produces a generally rectangular output voltage waveform having a 50% duty cycle. This rectangular waveform is applied to the control terminal of a controlled switching device, such as a MOSFET, which has its source-drain path coupled between a prescribed DC power supply rail and an output node. The output node is coupled to a first end of a primary winding of a step-up transformer. The coupling path to the primary winding includes leakage inductance of the primary winding. The step-up transformer has a very substantial secondary to primary turns ratio, so that the voltage produced across its secondary winding is on the order of several orders of magnitude larger than that applied to its primary winding. The second end of the transformer's primary winding is coupled to a capacitor referenced to ground.

The half-bridge DC-AC converter stage further contains a second pulse generator which also produces a generally rectangular output waveform having a 50% duty cycle, and the same frequency and amplitude as, but opposite phase relative to the rectangular waveform produced by the first pulse generator. The rectangular waveform produced by the second pulse generator is applied to the control terminal of another MOSFET, which has its source-drain path coupled between a prescribed DC power supply rail (e.g., ground) and the output node.

With the voltage waveforms produced by the two pulse generators having the same amplitude and frequency, but being of opposite phase, then whenever one MOSFET is turned ON, the other is turned OFF, and vice versa. When the first MOSFET is turned ON, current frows through the first MOSFET, into the transformers primary and the the capacitor to which the primary winding is coupled. When the first MOSFET is turned OFF, the other MOSFET is turned ON. Current flows from the capacitor, through the transformer primary and the other MOSFET to ground. The capacitor has a large value so the current flowing into and out of it results in a very small change in the capacitor voltage. Because of the 50% duty cycle of the MOSFET switching, the voltage on the capacitor will be approximately 50% of the voltage rail. This results in a 50% duty cycle square wave being applied to the primary coil of the transformer, and has the effect of producing a 50% duty cycle output waveform across the step-up transformer's secondary winding on the order of several thousand volts, in response to a twenty-four volt swing applied to its primary winding.

The secondary coil of the step-up transformer has a first end coupled to a resistor referenced to ground and a second end coupled to a first output port feeding the load. The resistor has a relatively low resistance and may be used to measure the current in the load. The path coupling the secondary winding to the output port includes the secondary winding's leakage inductance. A capacitor is coupled between the first output port and the first end of the transformer's secondary winding. The leakage inductance and the capacitor form an low pass filter circuit with the secondary winding, which serves to convert the generally rectangular waveform produced across the secondary winding of the transformer into a generally sinusoidal waveform at the first output port. The second half-bridge DC-AC converter stage is configured essentially the same as the first DC-AC converter stage, and is operative to generate a generally sinusoidal waveform at the second output port which, as described above, is adapted to be coupled to the other an end of a high voltage load (e.g., CCFL).

The operation of the half-bridge topology is such that a relatively large phase difference between the waveforms used to control the switching of the two half-bridge DC-AC converter stages is effective in producing a relatively large amplitude sinusoidal voltage across the load, whereas a relatively small or negligible phase difference between the waveforms used to control the switching of the two half-bridge DC-AC converter stages is effective in producing a relatively small or nearly zero amplitude resultant voltage across the load.

In accordance with a preferred implementation, the half-bridge topology of the present invention comprises a first, dual driver stage that implements pulse generators of the first converter stage, and a second, dual driver stage that implements pulse generators of the second converter stage. A phase offset control stage is used to modulate the phase differential between the waveforms applied to the output ports and thereby control the resultant voltage applied across the load. The first dual driver stage comprises a toggle flip-flop having its input coupled to receive an input clock signal having a frequency which corresponds to that of the intended sinusoidal waveforms to be produced at the output ports. The toggle flip-flop has its Q and QBAR outputs coupled to respective drivers of a dual driver stage that drives the gate inputs of the first pair of MOSFETs. Similarly, the second dual driver stage comprises a toggle flip-flop having its input coupled to receive a controllably delayed version of the input clock signal, as supplied by a voltage-controlled delay circuit within a phase offset control stage. In accordance with a non-limiting example, the voltage-controlled delay circuit may be implemented as a voltage controlled one-shot. The second toggle flip-flop has its Q and QBAR outputs coupled to respective drivers of a second dual driver stage that drives the gate inputs of the second pair of MOSFETs.

The voltage-controlled delay stage 831 has a control input coupled to the output of an error amplifier and an output coupled to the input of toggle flip-flop of the second dual driver stage. The error amplifier has its non-inverting (+) input coupled to the output of an absolute value circuit, the input of which is coupled to the resistor referenced to ground and coupled to the secondary winding of the first step-up transformer. The inverting (−) input of the error amplifier is coupled to receive a control voltage that is used to establish the resultant voltage differential applied between the two output ports, and thereby across the load. In particular, the control voltage is used to control the delay imparted by the voltage-controlled delay to the input clock signal, and thereby the phase offset between the clock signals being applied to the two toggle flip-flops.

For the example of the load corresponding to a CCFL, the voltage applied to the error amplifier may correspond to a brightness representative voltage for setting the brightness of the CCFL in proportion to the magnitude of the control voltage. As pointed out above, the larger the phase difference between the respective voltage waveforms applied to the opposite ends of the load, the greater the voltage difference developed across the load. To this end, as the brightness control voltage applied to the error amplifier is varied, the output of the error amplifier will correspondingly change the delay imparted to the input clock signal by the voltage controlled delay circuit, so as to vary the phase difference between the two clock signals used to toggle the two flip-flops.

Thus, the delay/brightness voltage applied to the error amplifier may be increased or ramped up from a first or minimum value (e.g., zero volts) to a second relatively larger value. At and in the vicinity of the minimum control voltage (zero volts), the delay or phase offset imparted by the voltage controlled delay is a relatively small value, so that the phase offset between the two output waveforms is also relatively small, resulting in a waveform having a generally spike-shaped characteristic, which produces a very small or nearly zero resultant voltage across the load. On the other hand, at and in the vicinity of the relatively large value of control voltage, the delay or phase offset imparted by the voltage controlled delay is a relatively large value, so that the phase offset between the two output waveforms is also a large value, resulting in a waveform having a generally step-shaped characteristic, so as to produce a relatively large amplitude sinusoidal voltage across the load.

DETAILED DESCRIPTION

Figure 1:
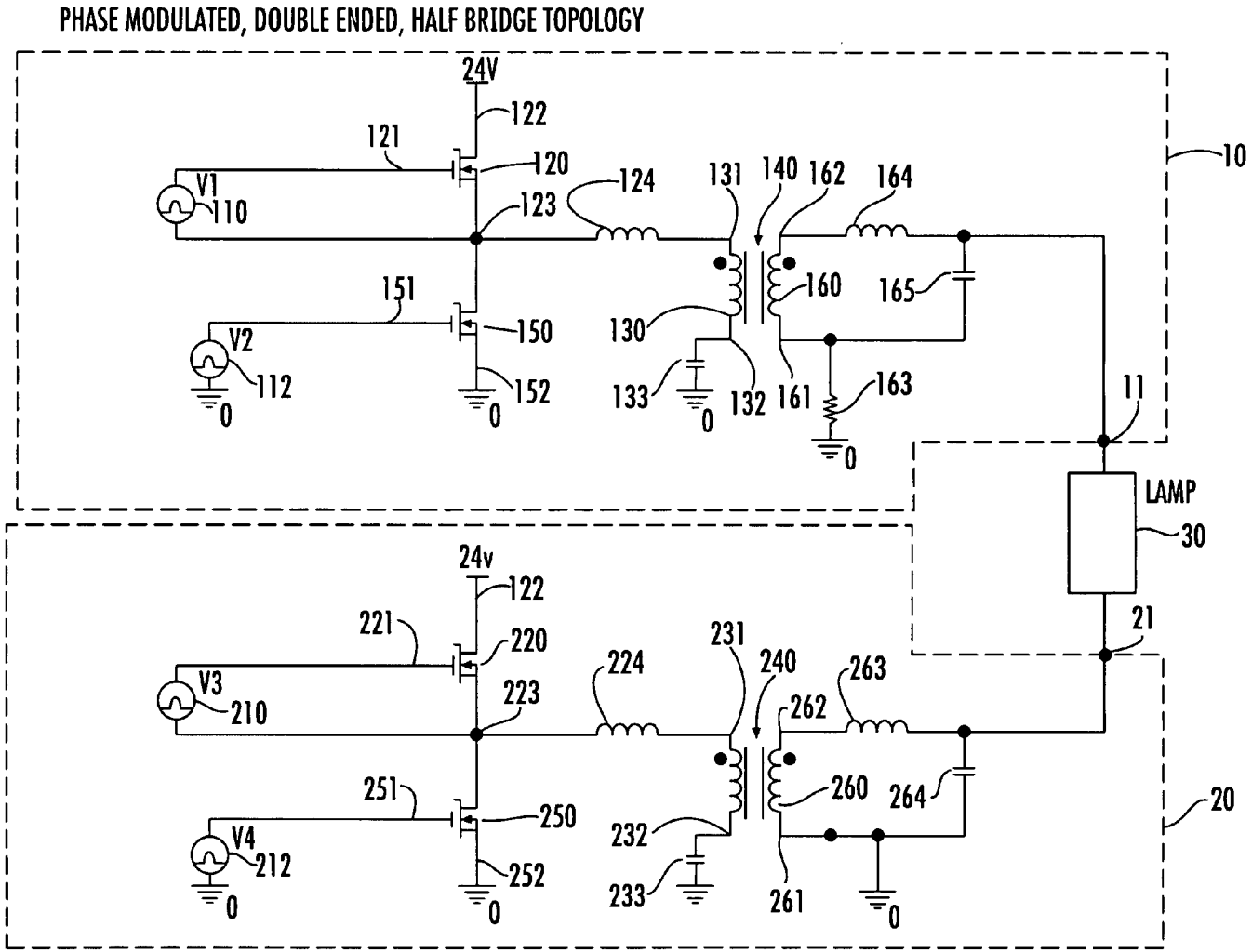
FIG. 1 diagrammatically illustrates an embodiment of a DC-AC controller and driver architecture for a double-ended, half-bridge inverter arrangement for powering a load such as a cold cathode fluorescent lamp in accordance with the present invention.

Before detailing the phase modulation-based, double-ended, half-bridge DC-AC converter architecture of the present invention, it should be observed that the invention resides primarily in a prescribed novel arrangement of conventional controlled power supply circuits and components. Consequently, the configurations of such circuits and components and the manner in which they may be interfaced with a driven load, such as a cold cathode fluorescent lamp have, for the most part, been shown in the drawings by readily understandable schematic block diagrams, and associated waveform diagrams, which show only those specific aspects that are pertinent to the present invention, so as not to obscure the disclosure with details which will be readily apparent to those skilled in the art having the benefit of the description herein. Thus, the schematic block diagrams are primarily intended to show the major components of various embodiments of the invention in convenient functional groupings, whereby the present invention may be more readily understood.

Attention is initially directed to FIG. 1, wherein an embodiment of the phase-modulated, double-ended, half-bridge topology based DC-AC converter in accordance with the present invention is schematically illustrated as comprising first and second, half-bridge DC-AC converter stages 10 and 20, respective output ports 11 and 21 of which are coupled to opposite ends of a load 30, such as but not limited to a cold cathode fluorescent lamp (CCFL). As will be detailed below, respective ones of the double-ended, half-bridge DC-AC converter stages 10 and 20 are operative to produce first and second sinusoidal voltage waveforms having the same frequency and amplitude, but having a controlled or modulated phase difference therebetween, which is effective to modulate the amplitude of the resultant or composite voltage waveform produced across the opposite ends of the load (CCFL) 30.

For this purpose, the first half-bridge DC-AC converter stage 10 comprises a first pulse generator 110, which produces a generally rectangular output voltage waveform having a 50% duty cycle. This rectangular waveform is applied to the control terminal 121 of a controlled switching device 120. In accordance with a non-limiting, but preferred embodiment, controlled switching device 120 may be implemented by means of a MOSFET, which has its source-drain path coupled between a prescribed DC power supply rail 122 (e.g., 24 volts, as shown) and an output node 123. The output node 123 of MOSFET 120 is coupled to a first end 131 of a primary winding 130 of a step-up transformer 140. The coupling path to the primary winding includes leakage inductance of the primary winding, as shown at 124. Step-up transformer 140 has a very substantial secondary to primary turns ratio, so that the voltage produced across its secondary winding 160 is on the order of several orders of magnitude larger than that applied to its primary winding. The second end 132 of the transformer's primary winding 130 is coupled to a capacitor 133 referenced to ground.

Half-bridge DC-AC converter stage 10 further comprises a second pulse generator 112, which produces a generally rectangular output waveform having a 50% duty cycle, and the same frequency and amplitude as, but opposite phase relative to the rectangular waveform produced by pulse generator 110. The rectangular waveform produced by pulse generator 112 is applied to the control terminal 151 of a further controlled switching device 150 which, like switching device 120, may be implemented as a MOSFET. MOSFET 150 has its source-drain path coupled between a prescribed DC power supply rail 152 (e.g., ground) and output node 123.

With the voltage waveforms produced by pulse generators 110 and 112 having the same amplitude and frequency, but being of opposite phase, then whenever switch/MOSFET 120 is turned ON, switch/MOSFET 150 is turned off, and vice versa. When MOSFET 120 is turned ON (MOSFET 150 is OFF), current flows from voltage rail 122 (24V in the present example), through switch/MOSFET 120, into node 131 of primary coil 130 and into capacitor 133. When MOSFET 120 is turned OFF, MOSFET 150 is ON, current flows from capacitor 133, into node132 of primary coil 130, through switch/MOSFET 150 to ground. Capacitor 133 has a relatively large value so the current flowing into and out of it produces a very small change in its voltage. Because of the 50% duty cycle of the switches/ MOSFETs, the voltage on capacitor 133 will be close to 50% of the voltage rail 122. This results in a 50% duty cycle square wave being applied to the primary coil 130 of transformer 140. With transformer 140 being a step-up transformer having a very substantial secondary to primary turns ratio, as described above, this has the effect of producing a 50% duty cycle output waveform across secondary winding 160 on the order of several thousand volts, in response to a twenty-four volt swing applied to its primary winding.

The secondary coil 160 of step-up transformer 140 has a first end 161 coupled through a resistor 163 to a reference voltage (e.g., ground) and a second end 162 coupled to the first output port 11. Resistor 163 has a resistance corresponding to that of the load 30. The path coupling the secondary winding to the output port 11 is shown as including secondary winding leakage inductance 164. A capacitor 165 is coupled between output port 11 and the first end 161 of the transformer's secondary winding 160. Leakage inductance 164 and capacitor 165 form an LC circuit with the secondary winding 160, which serves to convert the generally rectangular waveform produced across the secondary winding 160 of transformer 140 into a generally sinusoidal waveform at output port 11. As described above, output port 11 is adapted to be coupled to one end of a high voltage load 30, such as a CCFL.

The second half-bridge DC-AC converter stage 20 is configured essentially the same as the first DC-AC converter stage, and comprises a first pulse generator 210, which produces a generally rectangular voltage waveform having the same frequency and amplitude as the waveforms produced by the pulse generators of the first half-bridge DC-AC converter stage and a 50% duty cycle. This rectangular waveform is applied to the control terminal 221 of a controlled switching device 220. As in the first converter stage 10, controlled switching device 220 may be readily implemented by means of a MOSFET, which has its source-drain path coupled between the DC power supply rail 122 (e.g., 24 volts) and an output node 223. The output node 223 of the controlled switch/MOSFET 220 is coupled to a first end 231 of a primary winding 230 of a step-up transformer 240. This coupling path includes leakage inductor 224 of the transformer's primary winding. The second end 232 of the transformer's primary winding 230 is coupled to a capacitor 233, referenced to ground.

Half-bridge DC-AC converter stage 20 further comprises a second pulse generator 212, which produces a generally rectangular output waveform having a 50% duty cycle, and the same frequency and amplitude as, but opposite phase relative to, the rectangular waveform produced by pulse generator 210. The rectangular waveform produced by pulse generator 212 is applied to the control terminal 251 of a further controlled switching device 250, shown as being implemented as a MOSFET, which has its source-drain path coupled between a prescribed DC power supply rail 252 (e.g., ground) and output node 223, which is coupled to the first end 231 of the primary winding 230 of step-up transformer 240.

As is the case with the first converter stage 10, the waveforms produced by pulse generators 210 and 212 of the second converter stage 20 have the same amplitude and frequency, but are of opposite phase, so that whenever MOSFET 220 is turned ON, MOSFET 250 is turned OFF, and vice versa. When MOSFET 220 is turned ON (MOSFET 250 is OFF), current flows from voltage rail 122 (24V), through switch/MOSFET 220, into node 231 of primary coil of transformer 240 and into capacitor 233. When MOSFET 220 is turned OFF, MOSFET 250 is turned ON, current flows from capacitor 233, into node 232 of the primary of transformer 240 and through the source-drain path of MOSFET 250 to ground. Capacitor 233 has a relatively large value so the current flowing into and out of it produces a very small change in its voltage. Because of the 50% duty cycle of the switches/MOSFETs, the voltage on capacitor 233 will be close to 50% of the voltage rail 122. As in the case of the first converter stage 10, this results in a 50% duty cycle square wave being applied to the primary winding 230 of transformer 240. Transformer 240 is also a step-up transformer having a substantial secondary to primary turns ratio, which has the effect of producing a 50% duty cycle output waveform across its secondary winding 260 on the order of several thousand volts in response to a twenty-four volt swing of the waveform applied to its primary winding.

The secondary coil 260 of step-up transformer 240 has a first end 261 coupled to a reference voltage (e.g., ground) and a second end 262 coupled to the second output port 21. The path from the secondary coil 260 to the second output port 21 includes leakage inductance 263 of the secondary winding 260. A capacitor 264 is coupled between output port 21 and the first end 261 of the transformer's secondary winding 260. Leakage inductance 263 and capacitor 264 form a tank circuit with the secondary winding, that serves to convert the rectangular waveform produced across the secondary winding 260 into a generally sinusoidal waveform at output port 21. As described above, output port 21 is adapted to be coupled to an end of a high voltage load such as a CCFL 30, opposite to that of the first port 11.

Figures 2, 3, 4:
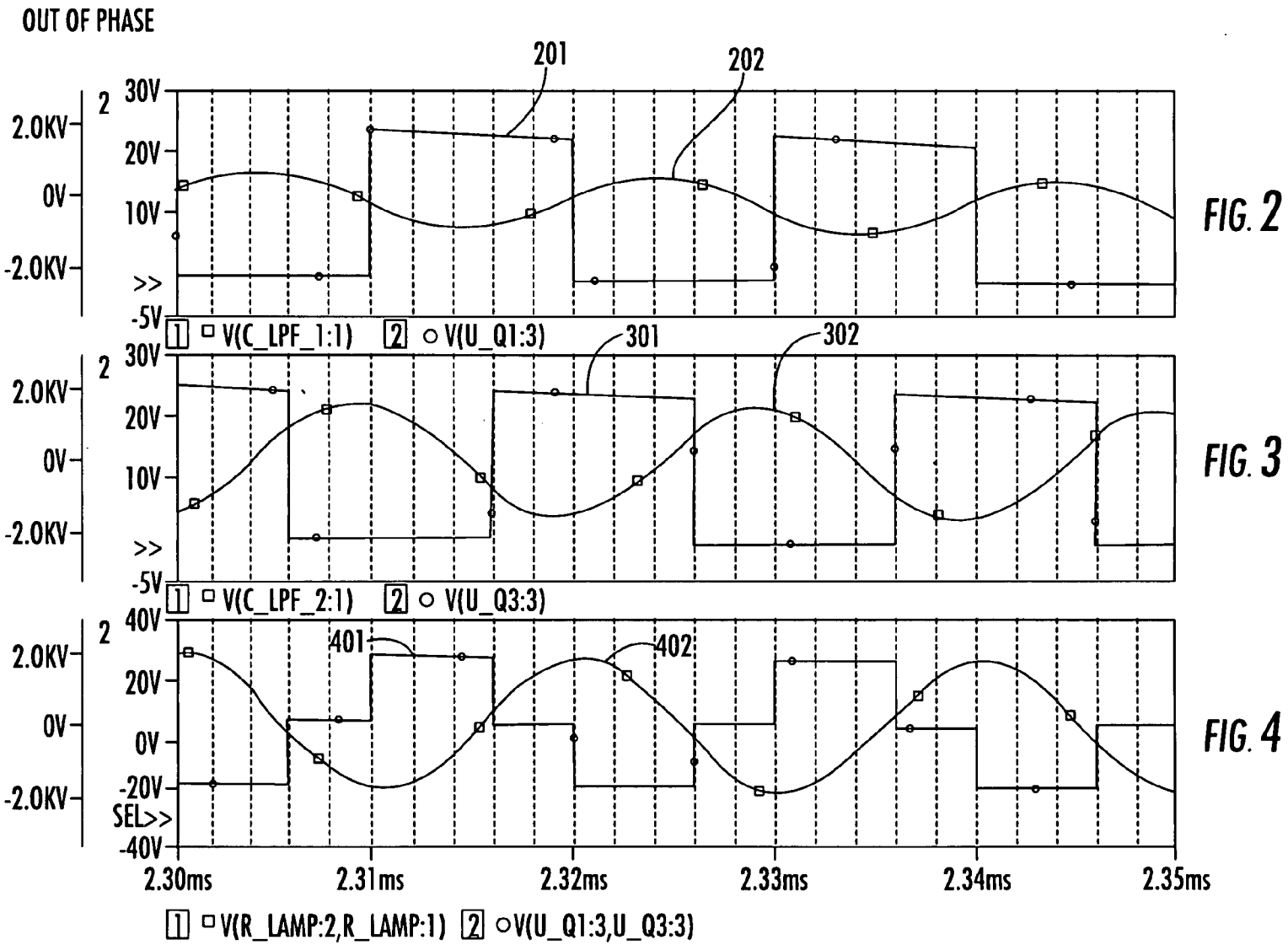
FIGS. 2, 3 and 4 are waveform diagrams associated with the operation of the phase-modulated, double-ended, half-bridge based DC-AC converter of FIGS. 1 and 2 for the case of a substantial phase shift between the sinusoidal output voltages supplied by the converter to opposite ends of the load, so as to realize a relatively large differential sinusoidal voltage across the load.
Figures 5, 6, 7:
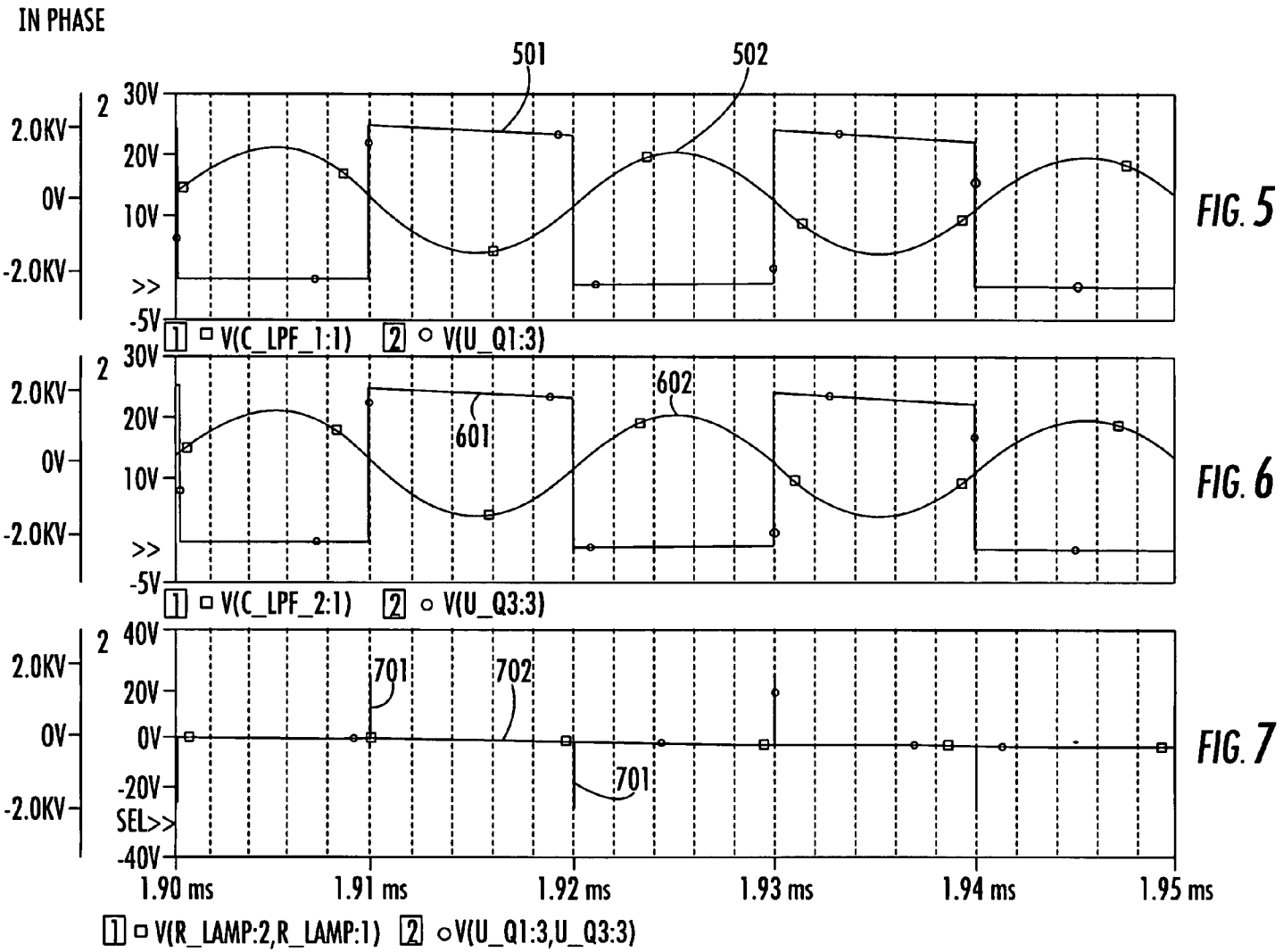
FIGS. 5, 6 and 7 are waveform diagrams associated with the operation of the phase-modulated, double-ended, half-bridge based DC-AC converter of FIGS. 1 and 2 for the case of a relatively small phase shift between the sinusoidal output voltages supplied by the converter to opposite ends of the load, so as to realize a relatively small differential sinusoidal voltage across the load.

The operation of the double-ended, half-bridge topology DC-AC converter of FIG. 1, described above, may be readily understood with reference to the waveforms of FIGS. 2–7, wherein FIGS. 2–4 are associated with a relatively large phase difference between the input waveforms and resulting output voltage waveforms produced by half-bridge DC-AC converter stages 10 and 20, whereas FIGS. 5–7 are associated with a relatively small phase difference between the input waveforms and resulting output voltage waveforms produced by half-bridge DC-AC converter stages 10 and 20.

More particularly, FIG. 2 shows the case of the alternating turning ON and OFF of MOSFETs 120 and 150 with a 50% duty cycle pulse waveform to produce a generally square wave waveform signal 201, which varies in amplitude between the two supply rail voltages (zero and twenty-four volts), and which is applied to the primary winding 130 of step-up transformer 140 of half-bridge DC-AC converter stage 10. Waveform 202 corresponds to the sinusoidal output voltage waveform that is produced by at output port 11. As shown in FIG. 2, this sinusoidal output voltage has a frequency that is the same as that of the waveform 201 and an amplitude that varies between values on the order of +/−500 VDC.

Similarly, FIG. 3 shows the case of the alternating turning ON and OFF of MOSFETs 220 and 250 of half-bridge DC-AC converter stage 20, with a pulse waveform having a 50% duty cycle, to produce a generally square wave waveform signal 301, that also varies in amplitude between the two supply rail voltages (zero and twenty-four volts), and is applied to the primary winding 230 of step-up transformer 240. Waveform 302 corresponds to the output voltage waveform that is produced at output port 21. As shown in FIG. 3, this output voltage waveform has a frequency that is the same as that of the waveform 301 and an amplitude that varies between values on the order of +/−1400 VDC. It is to be noted that the waveforms 301 and 302 of FIG. 3 are shifted in phase a substantial amount with respect to the waveforms 201 and 202 of FIG. 2.

FIG. 4 shows the composite of the two sets of waveforms of FIGS. 2 and 3 as produced across the (CCFL) load 30. As shown therein, the composite 401 of the two waveforms 201 and 301 has a generally step-shaped characteristic, while the composite 402 of the two sinusoidal waveforms 202 and 302 is a sinusoidal waveform of the same frequency of each of waveforms 202 and 302, but having a resultant amplitude on the order of +/−1900 VDC. Thus, from FIGS. 2–4 it can be seen that a relatively large phase difference between the waveforms used to control the switching of the two half-bridge DC-AC converter stages is effective in producing a relatively large amplitude sinusoidal voltage across the load 30.

FIG. 5 is similar to FIG. 2, in that it shows the case of the alternate turning ON and OFF of MOSFETs 120 and 150 with a 50% duty cycle waveform to produce a generally square wave signal 501, that varies in amplitude between the two supply rail voltages (zero and twenty-four volts), and which is applied to the primary winding 130 of step-up transformer 140 of half-bridge DC-AC converter stage 10. Waveform 502 corresponds to the output sinusoidal voltage produced at output port 11. As shown in FIG. 5, this sinusoidal output voltage has a frequency that is the same as that of the waveform 501 and an amplitude that varies between values on the order of +/−1500 VDC.

FIG. 6 shows the case of the alternate turning ON and OFF of MOSFET switches 220 and 250 of the half-bridge DC-AC converter stage 20, with a 50% duty cycle waveform—producing a generally square wave waveform signal 601, that varies in amplitude between the two supply rail voltages (zero and twenty-four volts), and is applied to the primary winding 230 of step-up transformer 240. Waveform 602 corresponds to the sinusoidal output voltage waveform produced at output port 201. As shown in FIG. 6, this sinusoidal output voltage has a frequency that is the same as that of the waveform 601 and an amplitude that varies between values on the order of +/−1500 VDC. It is to be noted that the waveforms 601 and 602 of FIG. 6 are shifted in phase only a negligible amount with respect to waveforms 501 and 502 of FIG. 5.

FIG. 7 shows the composite of the two sets of waveforms of FIGS. 5 and 6 as produced across the (CCFL) load 30. As shown therein, the composite 701 of the two generally square wave waveforms 501 and 601 has a "spiked" characteristic, with 'spike' like transients occurring at the generally proximate low-to-high and high-to-low transitions of waveforms 501 and 601. The composite 702 of the two sinusoidal waveforms 502 and 602 has resultant amplitude on the order of zero volts DC. Thus, a relatively small or negligible phase difference between the waveforms used to control the switching of the two half-bridge DC-AC converter stages is effective in producing a very small or nearly zero resultant voltage across the load 30.

Figure 8:
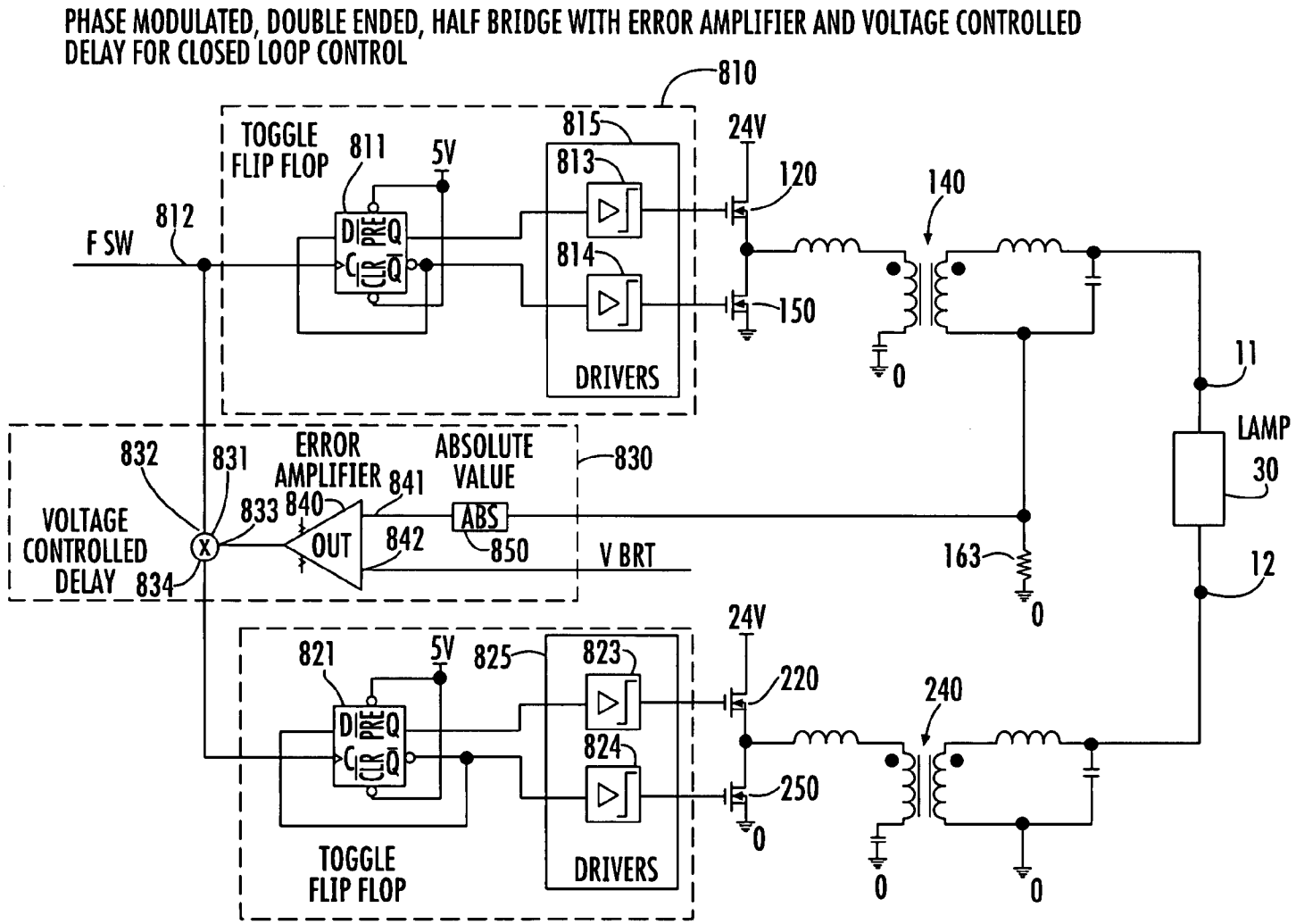
FIG. 8 diagrammatically illustrates a non-limiting example of a practical implementation of the DC-AC controller and driver architecture for the double-ended, half-bridge inverter arrangement of FIG. 1.

Attention is now directed to FIG. 8, which diagrammatically illustrates a non-limiting example of a practical implementation of the DC-AC controller and driver architecture for the double-ended, half-bridge inverter arrangement of FIG. 1. In particular, FIG. 8 shows a first, dual driver stage 810 that implements the pulse generators 110 and 112 of the first converter stage 10 of FIG. 1, and a second, dual driver stage 820 that implements the pulse generators 210 and 212 of the second converter stage 20 of FIG. 1, as well as a phase offset control stage 830, which serves to modulate the phase differential between the waveforms applied to the output ports 11 and 21, and thereby control the resultant voltage applied across the load 30. The remainder of the circuitry of FIG. 8 is the same as that shown in FIG. 1, and will not be redescribed.

The first dual driver stage 810 comprises a toggle flip-flop 811 having its input coupled to receive an input clock signal on input line 812, the input clock signal having a frequency which corresponds to that of the intended sinusoidal waveforms to be produced at output ports 11 and 12. Toggle flip-flop 811 has its Q and QBAR outputs coupled to respective drivers 813 and 814 of a dual driver stage 815, that drives the gate inputs of MOSFETs 120 and 150. The second dual driver stage 820 comprises a toggle flip-flop 821 having its input coupled to receive a controllably delayed version of the input clock signal on input line 812, as supplied by a voltage-controlled delay circuit 831 within the phase offset control stage 830. In accordance with a non-limiting example, voltage-controlled delay circuit may be implemented as a voltage controlled one-shot. Toggle flip-flop 821 has its Q and QBAR outputs coupled to respective drivers 823 and 824 of a dual driver stage 825, that drives the gate inputs of MOSFETs 220 and 250.

Within the phase offset control stage 830, voltage-controlled delay stage 831 has a signal input 832 coupled to input line 812, a control input 833 coupled to the output of an error amplifier 840 and an output 834 coupled to the input of toggle flip-flop 821 of the second dual driver stage 820. Error amplifier 840 has its non-inverting (+) input 841 coupled to the output of an absolute value circuit 850, the input of which is coupled to resistor 163. Resister 163 creates a voltage representation of the current in the load. The inverting (−) input 842 of error amplifier 840 is coupled to receive a control voltage that is used to establish the resultant voltage differential applied between output ports 11 and 12, and thereby the current in the load 30. In particular, the control voltage is used to control the delay imparted by voltage-controlled delay 831 to the input clock signal applied to line 812, and thereby the phase offset between the clock signals being applied to the toggle flip-flops 811 and 821.

For the example of the load 30 corresponding to a CCFL, the voltage applied to the input 842 of error amplifier 840 may correspond to a brightness representative voltage V BRT for setting the brightness of the CCFL in proportion to the magnitude of the control voltage. As pointed out above in connection with the description of FIGS. 2–4 and FIGS. 5–7, the larger the phase difference between the respective voltage waveforms applied to the opposite ends of the load, the greater the voltage difference developed across the load. To this end, as the voltage applied to error amplifier input 842 is varied, the output of the error amplifier will correspondingly change the delay imparted to the input clock signal by voltage controlled delay circuit 831, so as to vary the phase difference between the two clock signals used to toggle flip-flops 811 and 821. Thus, as shown in FIG. 9, the delay control voltage V BRT applied to the error amplifier may be increased or ramped up from a first or minimum value (e.g., zero volts) at 901 to a second relatively larger value at 902.

Figures 9, 10, 11, 12:
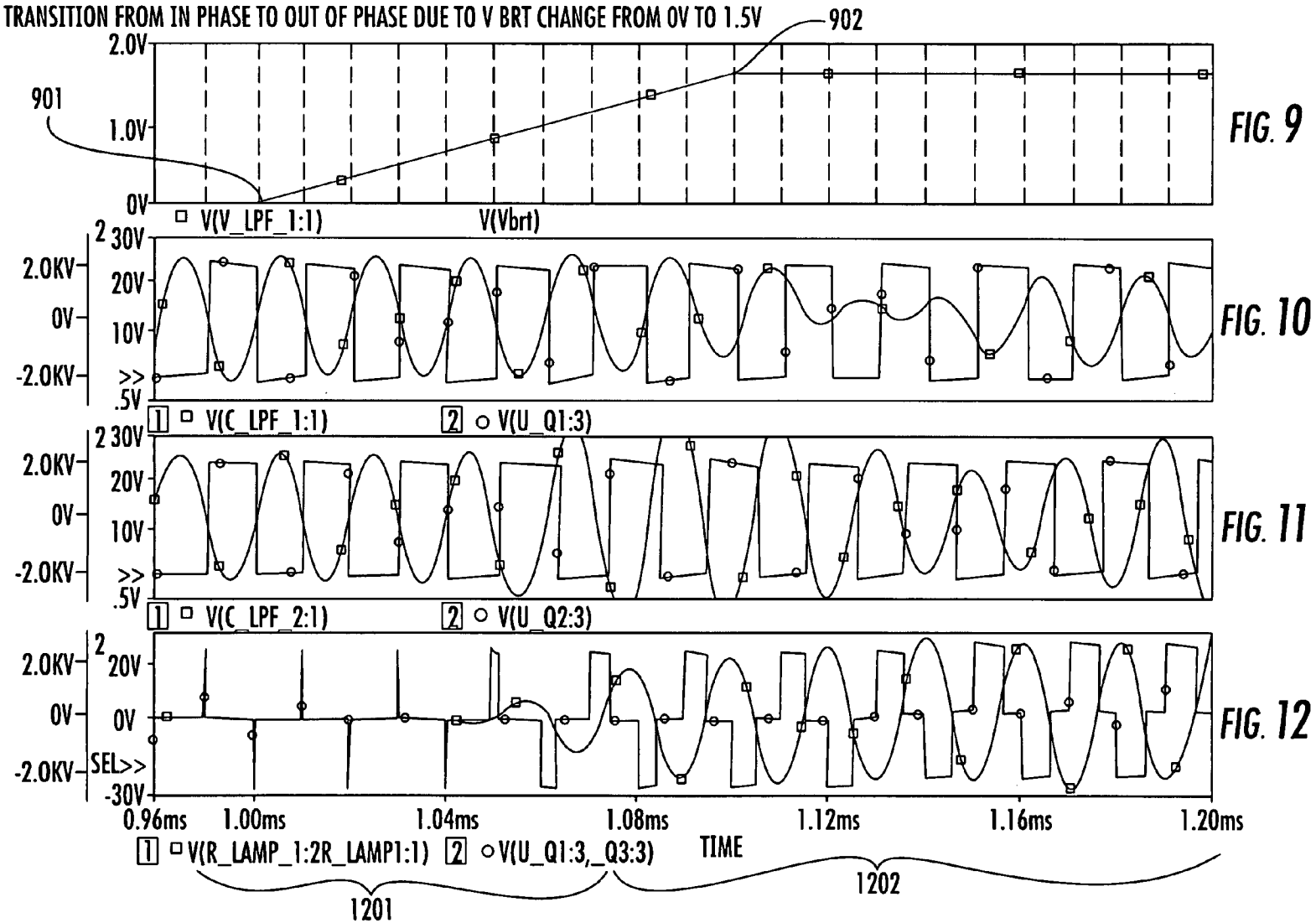
FIGS. 9, 10, 11 and 12 are waveform diagrams associated with the operation of the phase-modulated, double-ended, half-bridge based DC-AC converter for the case of a variation in phase shift between the sinusoidal output voltages supplied by the converter to opposite ends of the load, from a relatively small phase shift value to a relatively large phase shift value, as a result in variation in brightness control voltage applied to the error amplifier of FIG. 8.

As shown in FIGS. 10 and 11, at and in the vicinity of the minimum control voltage (zero volts), the delay or phase offset imparted by voltage controlled delay 831 is a relatively small value, so that the phase offset between the two output waveforms is also relatively small, resulting in the waveform shown FIG. 12 having a generally spike-shaped characteristic 1201, as described above with reference to FIGS. 5–7, producing a very small or nearly zero resultant voltage across the load. On the other hand, at and in the vicinity of the relatively large value of control voltage, the delay or phase offset imparted by voltage controlled delay 831 is a relatively large value, so that the phase offset between the two output waveforms is also a large value, resulting in the waveform shown FIG. 12 having a generally step-shaped characteristic 1202, as described above with reference to FIGS. 2–4, producing a relatively large amplitude sinusoidal voltage across the load.

As will be appreciated from the foregoing description, disadvantages of conventional high voltage AC power supply system architectures, including systems for supplying AC power to CCFLs used to back-light an LCD panel, are effectively obviated by the phase-modulated, double-ended, half-bridge DC-AC converter architecture of the present invention, which is operative to drive opposite ends of a load, such as a CCFL, with a first and second sinusoidal voltages having the same frequency and amplitude, but having a controlled phase difference therebetween. By controlling the phase difference between the first and second sinusoidal voltages, the present invention is able to vary the amplitude of the composite voltage differential produced across the opposite ends of the load.

While we have shown and described an embodiment in accordance with the present invention, it is to be understood that the same is not limited thereto but is susceptible to numerous changes and modifications as known to a person skilled in the art. We therefore do not wish to be limited to the details shown and described herein, but intend to cover all such changes and modifications as are obvious to one of ordinary skill in the art.

What is claimed is:

1. An apparatus for supplying AC power to a high voltage load comprising first and second half-bridge topology-configured DC-AC converter stages which are operative to drive opposite ends of said load with first and second sinusoidal voltages having the same frequency and amplitude, but having a modulated phase difference therebetween, which is effective to vary the amplitude of the composite AC voltage differential produced across the opposite ends of said load, wherein a respective converter stage contains a pair of pulse generators which generate substantially phase-complementary pulse signals of the same amplitude and frequency, but opposite phase, and having an approximately 50% duty cycle, said phase-complementary pulse signals being used to control ON/OFF conduction of a pair of controlled switching devices, connected in series between first and second voltage terminals and wherein a common connection of said switching devices is coupled to a first end of a primary coil of a step-up transformer, a second end of said primary coil being coupled to a capacitor that is referenced to a prescribed voltage, said step-up transformer having a secondary coil thereof coupled to a resonant filter circuit that is operative to convert a generally rectangular wave output produced across the secondary winding of the step-up transformer into a generally sinusoidal waveform.

2. The apparatus according to claim 1, wherein the phase of the sinusoidal waveform produced by the resonant filter circuit of one of said converter stages is modulated relative to the phase of the sinusoidal waveform produced by the resonant filter circuit of another converter stage, so as to modify the amplitude of the composite AC voltage differential produced between said opposite ends of said load.

3. The apparatus according to claim 2, further comprising a voltage-controlled delay circuit which is operative to impart a controlled amount of delay to pulse trains produced by pulse generators of said one of said converter stages relative to the pulse trains produced by pulse generators of said another of said converter stages, said controlled amount of delay between the two pulse trains controlling the amplitude of the composite AC voltage differential produced across said opposite ends of said load.

4. The apparatus according to claim 3, wherein said load comprises a cold cathode fluorescent lamp (CCFL).

5. The apparatus according to claim 3, wherein said voltage-controlled delay circuit includes an error amplifier that is coupled to receive a voltage representative of the current through said CCFL and a brightness control voltage, the magnitude of which controls the brightness of said (CCFL).

6. A method of supplying AC power to a high voltage load comprising the steps of:

(a) driving a first end of said load with a first sinusoidal voltage having a prescribed frequency and amplitude as produced by a first half-bridge topology-configured DC-AC converter stage;

(b) driving a second end of said load with a second sinusoidal voltage having said prescribed frequency and amplitude as produced by a second half-bridge topology-configured DC-AC converter stage;

(c) modulating the phase difference between said first and second sinusoidal voltages so as to vary the amplitude of the composite AC voltage differential produced across the opposite ends of said load, wherein a respective converter stage contains a pair of pulse generators which generate substantially phase-complementary pulse signals of the same amplitude and frequency, but opposite phase, and having an approximately 50% duty cycle, said phase-complementary pulse signals being used to control ON/OFF conduction of a pair of controlled switching devices, connected in series between first and second voltage terminals, and wherein a common connection of said switching devices is coupled to a first end of a primary coil of a step-up transformer, a second end of said primary coil being coupled to a capacitor that is referenced to a prescribed voltage, said step-up transformer having a secondary coil thereof coupled to a resonant filter circuit that is operative to convert a generally rectangular wave output produced across the secondary winding of the step-up transformer into a generally sinusoidal waveform.

7. The method according to claim 6, wherein the phase of the sinusoidal waveform produced by the resonant filter circuit of one of said converter stages is modulated relative to the phase of the sinusoidal waveform produced by the resonant filter circuit of another converter stage, so as to modify the amplitude of the composite AC voltage differential produced between said opposite ends of said load.

8. The method according to claim 7, wherein step (c) comprises imparting a controlled amount of delay to pulse trains produced by pulse generators of said one of said converter stages relative to the pulse trains produced by pulse generators of said another of said converter stages, said controlled amount of delay between the two pulse trains modulating the phase difference between said first and second sinusoidal voltages so as to vary the amplitude of the composite AC voltage differential produced across the opposite ends of said load.

9. The method according to claim 8, wherein said load comprises a cold cathode fluorescent lamp (CCFL).

10. The method according to claim 8, wherein step (c) comprises driving a voltage-controlled delay circuit with the output of an error amplifier that is coupled to receive a voltage representative of the current through said CCFL and a brightness control voltage, the magnitude of which controls the brightness of said (CCFL).

11. An apparatus for supplying variable AC power to a load comprising:

a first half-bridge topology-configured DC-AC converter stage, which is operative to drive a first end of said load with a first sinusoidal voltage having a prescribed frequency and amplitude;

a second half-bridge topology-configured DC-AC converter stage, which is operative to drive a second end of said load with a second sinusoidal voltage having said prescribed frequency and amplitude; and a phase modulation controller which is operative to modulate the relative phase between said first and second sinusoidal voltages and thereby vary the amplitude of the composite AC voltage differential produced across opposite ends of said load, wherein each of said first and second converter stages comprises a pair of pulse generators which generate substantially phase-complementary pulse signals of the same amplitude and frequency, but opposite phase, and having an approximately 50% duty cycle, said phase-complementary pulse signals being used to control ON/OFF conduction of a pair of controlled switching devices, connected in series between first and second voltage terminals and wherein a common connection of said switching devices is coupled to a first end of a primary coil of a step-up transformer, a second end of said primary coil being coupled to a capacitor that is referenced to a prescribed voltage, said step-up transformer having a secondary coil thereof coupled to a resonant filter circuit that is operative to convert a generally rectangular wave output produced across the secondary winding of the step-up transformer into a generally sinusoidal waveform.

12. The apparatus according to claim 11, wherein the phase of the sinusoidal waveform produced by the resonant filter circuit of said first converter stage is modulated by said phase modulation controller relative to the phase of the sinusoidal waveform produced by the resonant filter circuit of said second converter stage, so as to vary the amplitude of the composite AC voltage differential produced between said opposite ends of said load.

13. The apparatus according to claim 12, wherein said phase modulation controller includes a voltage-controlled delay circuit which is operative to impart a controlled amount of delay to pulse trains produced by pulse generators of said first converter stage relative to the pulse trains produced by pulse generators of said second converter stage, said controlled amount of delay between the two pulse trains controlling the amplitude of the composite AC voltage differential produced across said opposite ends of said load.

14. The apparatus according to claim 13, wherein said load comprises a cold cathode fluorescent lamp (CCFL).

15. The apparatus according to claim 13, wherein said voltage-controlled delay circuit includes an error amplifier that is coupled to receive a voltage representative of the current through said CCFL and a brightness control voltage, the magnitude of which controls the brightness of said (CCFL).

16. A method of supplying AC power to a high voltage load comprising the steps of:

(a) driving a first end of said load with a first sinusoidal voltage having a prescribed frequency and amplitude as produced by a first half-bridge topology-configured DC-AC converter stage;

(b) driving a second end of said load with a second sinusoidal voltage having said prescribed frequency and amplitude as produced by a second half-bridge topology-configured DC-AC converter stage;

(c) modulating the phase difference between said first and second sinusoidal voltages so as to vary the amplitude of the composite AC voltage differential produced across the opposite ends of said load; and wherein each converter stage contains a step-up transformer, each step-up transformer includes a primary coil having first and second ends, the second end of said primary coil being coupled to a capacitor that is referenced to a prescribed voltage, said step-up transformer having a secondary coil thereof coupled to a resonant filter circuit that is operative to convert a generally rectangular wave output produced across the secondary winding of the step-up transformer into a generally sinusoidal waveform.

17. An apparatus for supplying variable AC power to a load comprising:

a first half-bridge topology-configured DC-AC converter stage, which is operative to drive a first end of said load with a first sinusoidal voltage having a prescribed frequency and amplitude;

a second half-bridge topology-configured DC-AC converter stage, which is operative to drive a second end of said load with a second sinusoidal voltage having said prescribed frequency and amplitude;

a phase modulation controller which is operative to modulate the relative phase between said first and second sinusoidal voltages and thereby vary the amplitude of the composite AC voltage differential produced across opposite ends of said load; and wherein each of said first and second converter stages comprises a step-up transformer, an end of said primary coil being coupled to a capacitor that is referenced to a prescribed voltage, said step-up transformer having a secondary coil thereof coupled to a resonant filter circuit that is operative to convert a generally rectangular wave output produced across the secondary winding of the step-up transformer into a generally sinusoidal waveform.

18. An apparatus for supplying AC power to a high voltage load comprising first and second half-bridge topology-configured-DC-AC converter stages which are operative to drive opposite ends of said load with first and second sinusoidal voltages having the same frequency and amplitude, but having a modulated phase difference therebetween, which is effective to vary the amplitude of the composite AC voltage differential produced across the opposite ends of said load.

19. A method of supplying AC power to a high voltage load comprising the steps of:

(a) driving a first end of said load with a first sinusoidal voltage having a prescribed frequency and amplitude as produced by a first half-bridge topology-configured DC-AC converter stage;

(b) driving a second end of said load with a second sinusoidal voltage having said prescribed frequency and amplitude as produced by a second DC-AC converter stage;

(c) modulating the phase difference between said first and second sinusoidal voltages so as to vary the amplitude of the composite AC voltage differential produced across the opposite ends of said load.

20. An apparatus for supplying variable AC power to a load comprising:

a first half-bridge topology-configured DC-AC converter stage, which is operative to drive a first end of said load with a first sinusoidal voltage having a prescribed frequency and amplitude;

a second half-bridge topology-configured DC-AC converter stage, which is operative to drive a second end of said load with a second sinusoidal voltage having said prescribed frequency and amplitude; and a phase modulation controller which is operative to modulate the relative phase between said first and second sinusoidal voltages and thereby vary the amplitude of the composite AC voltage differential produced across opposite ends of said load.

21. An apparatus for supplying AC power to a high voltage load comprising first and second half-bridge topology-configured DC-AC converter stages which are operative to drive opposite ends of said load with first and second sinusoidal voltages having the same frequency and amplitude, but having a modulated phase difference therebetween, which is effective to vary the amplitude of the composite AC voltage differential produced across the opposite ends of said load and wherein each converter stage contains circuitry that is operative to convert a generally rectangular wave into a generally sinusoidal waveform to be applied to said load.

* * * * *